US009316020B2

(12) United States Patent
Lee et al.

(10) Patent No.: US 9,316,020 B2
(45) Date of Patent: Apr. 19, 2016

(54) DOOR INSIDE HANDLE DEVICE FOR VEHICLE

(71) Applicant: Hyundai Motor Company, Seoul (KR)

(72) Inventors: Sang Hyun Lee, Jeju-si (KR); Varma Rudraraju, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 200 days.

(21) Appl. No.: 14/104,551

(22) Filed: Dec. 12, 2013

(65) Prior Publication Data

US 2015/0084354 A1 Mar. 26, 2015

(30) Foreign Application Priority Data

Sep. 24, 2013 (KR) ..... 10-2013-0113054

(51) Int. Cl.
*E05B 3/00* (2006.01)
*E05B 1/00* (2006.01)
*E05B 7/00* (2006.01)

(52) U.S. Cl.
CPC . *E05B 1/003* (2013.01); *E05B 7/00* (2013.01); *Y10T 292/57* (2015.04)

(58) Field of Classification Search
CPC ... Y10T 292/57; Y10T 292/82; Y10T 292/85; E05B 85/12; E05B 79/20; Y10S 292/31; Y10S 16/24; Y10S 292/37
USPC ..... 292/336.3
See application file for complete search history.

(56) References Cited

U.S. PATENT DOCUMENTS

| | | | | | |
|---|---|---|---|---|---|
| 3,606,428 | A * | 9/1971 | Erck et al. | E05B 85/12 | 292/153 |
| 5,895,081 | A * | 4/1999 | Tanimoto | E05B 85/12 | 292/336.3 |
| 5,961,166 | A * | 10/1999 | Edwards | E05B 85/12 | 292/336.3 |
| 6,062,615 | A * | 5/2000 | Hunt | E05B 85/12 | 292/216 |
| 2013/0168979 | A1 * | 7/2013 | Minemura | E05B 85/12 | 292/336.3 |

FOREIGN PATENT DOCUMENTS

| | | | |
|---|---|---|---|
| JP | 09-032366 | A | 2/1997 |
| JP | 09-096131 | A | 4/1997 |
| JP | 2011-052497 | A | 3/2011 |
| JP | 2011-099238 | A | 5/2011 |
| JP | 2011-226207 | A | 11/2011 |
| KR | 1020080009840 | A | 1/2008 |
| KR | 1020110019273 | A | 2/2011 |

* cited by examiner

*Primary Examiner* — Mark Williams
(74) *Attorney, Agent, or Firm* — Morgan, Lewis & Bockius LLP

(57) ABSTRACT

A door inside handle device for a vehicle can perform the locking/unlocking and the opening of a door by applying a typical safety lock knob which is familiar to users while having a connection configuration using a single cable. The door inside handle device for a vehicle may include: a base mounted on a door panel; a safety lock knob pivotably on the base; a handle pivotably disposed on the base; a clutch lever coupled to the safety lock knob and a cable connected to a door latch to deliver operation force of the safety lock knob to the cable and selectively deliver an operation force applied to the handle to the cable; and a clutch unit disposed between the handle and the clutch lever to transmit operation force applied to the handle to the clutch lever according to an operation state of the safety lock knob.

9 Claims, 9 Drawing Sheets

(a) Lock (b) Unlock (c) Open

DOOR INSIDE HANDLE DEVICE FOR VEHICLE

CROSS-REFERENCE TO RELATED APPLICATION

The present application claims priority of Korean Patent Application Number 10-2013-0113054 filed Sep. 24, 2013, the entire contents of which application is incorporated herein for all purposes by this reference.

BACKGROUND OF INVENTION

1. Field of Invention

The present invention relates to a door inside handle device for a vehicle. More particularly, it relates to a door inside handle device for a vehicle, which enables a user to more easily operate the door inside handle device by a more familiar method.

2. Description of Related Art

Generally, a door latch is installed at a side of a door of a vehicle, and a striker is installed at a side of a vehicle body corresponding thereto to allow the door to be fixed to the vehicle body when the door latch is locked by the striker.

Also, a door inside handle device is provided at an inner side of the door of a vehicle to open or lock/unlock the door. The door latch moves in linkage with the operation of a knob and a handle of the door inside handle device to perform locking/unlocking and opening of the door.

FIG. 1 is a perspective view illustrating a typical door inside handle device and door latch.

Referring to FIG. 1, a door inside handle device 10 includes a handle 20 that is pulled to open the door and a safety lock knob 40 is installed at the same axis as the handle 20 to lock/unlock the door.

Also, the handle 20 is connected to a door latch 70 via a cable 30 to deliver an operation force applied to the door inside handle device to the door latch 70. The safety lock knob 40 is also connected to the door latch 70 via a cable 70.

In this case, when the safety lock knob 40 is in protruding state toward the inside of a vehicle, the handle 20 can be opened by the pulling of the handle 20. On the contrary, when the safety lock knob 40 is in flat state, the door will not be opened even though the handle 20 is pulled.

However, the device configuration of FIG. 1 includes the safety lock knob 40 for locking/unlocking the door, two cables 30 and 50 for delivering the operation force applied to the knob 40 and the handle 20, and the door latch 70. In this case, since the safety lock knob 40 and the handle 20 are connected to the door latch 80 through separate cables 30 and 50, respectively, the number of parts, the man hour for assembling, and the manufacturing cost increase.

In order to overcome these limitations, Korean Patent Nos. 10-1091658 (Dec. 2, 2011) and 10-1209605 (Dec. 3, 2012) disclose door locking devices in which the locking/unlocking and opening of a door can be all performed only by pulling and pushing of a handle while omitting a typical safety lock knob by adding a push lock function to the handle.

In these devices disclosed in the above patents, since a knob and a cable are omitted, the number of parts and the manufacturing cost can be reduced.

However, these devices have a limitation in that an additional space for pushing the handle in a lock direction is needed inside the housing.

Referring to FIG. 2, the handle 20 needs to be pushed to the inside of the housing for the locking of the door latch ((a) lock), and needs to be pulled to the neutral location for the unlocking of the door latch ((b) unlock). Also, the handle 20 needs to be fully pulled to open the door ((c) open).

Accordingly, a space that is needed when the handle is pushed has to be secured inside the housing.

As another limitation, since the knob is omitted, the handle 20 needs to be pushed for locking. However, this configuration may allow a user who is familiar with a typical knob for the safety lock operation to be confused, making it difficult to actually apply this configuration to a vehicle.

Since many users who are familiar with the knob operation may be poor at the operation method of the safety lock function, they may have a difficulty in using the safety lock function.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a door inside handle device for a vehicle, which allows a user to easily operate even when the door inside handle device is applied to a latch mechanism of one cable operation type.

Various aspects of the present invention provide for a door inside handle device for a vehicle, which can perform the locking/unlocking and the opening of a door by the same method as a related art by applying a typical safety lock knob which is familiar to users while having a connection configuration using a single cable.

In various aspects, the present invention provides a door inside handle device for a vehicle, including: a base mounted on a door panel; a safety lock knob pivotably disposed on the base; a handle pivotably disposed on the base; a clutch lever coupled to the safety lock knob and a cable connected to a door latch to deliver an operation force applied to the safety lock knob to the cable and selectively deliver an operation force applied to the handle to the cable; and a clutch unit disposed between the handle and the clutch lever to transmit or intermit the operation force applied to the handle to the clutch lever according to an operation state of the safety lock knob.

The present methods and apparatuses have other features and advantages apparent from the accompanying drawings, incorporated herein, and below Detailed Description, which together serve to explain certain principles of the present invention.

Figure 1:
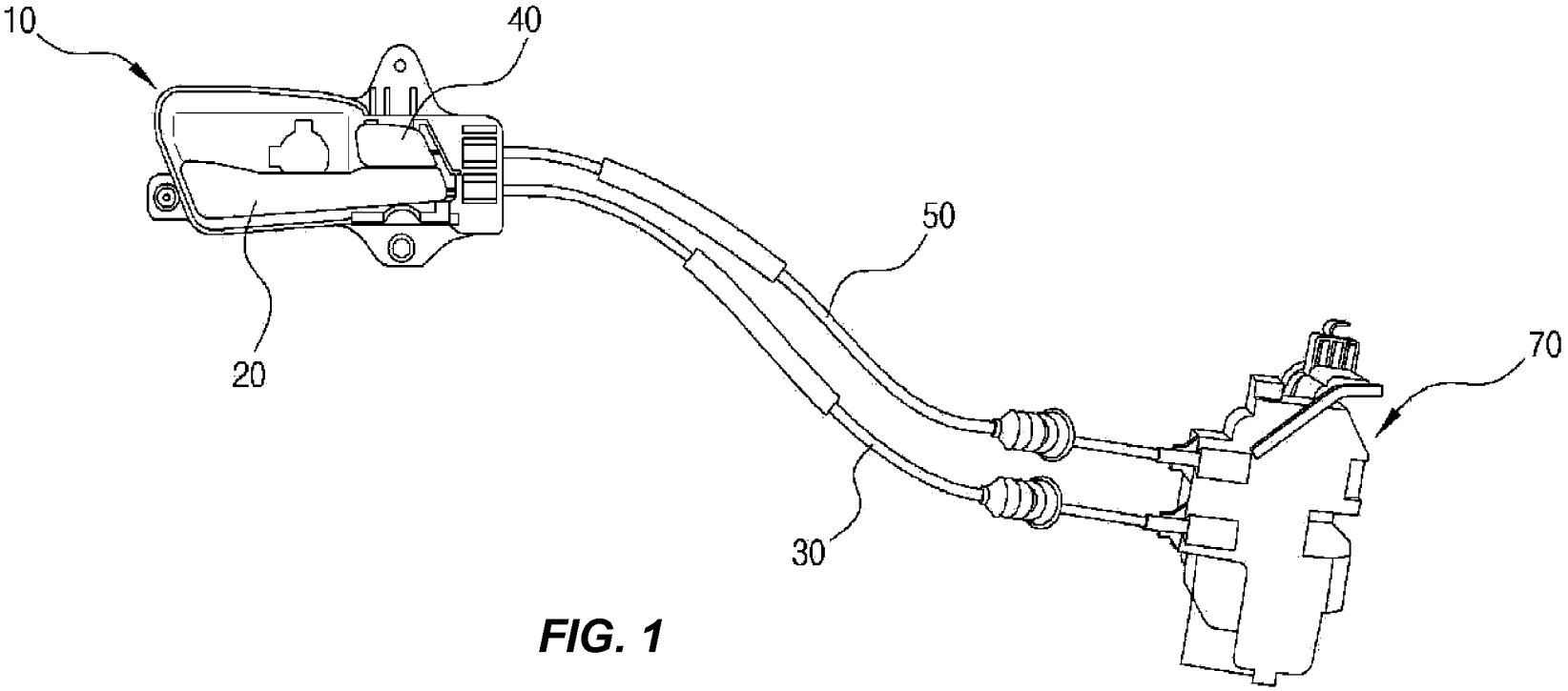
FIG. 1 is a perspective view illustrating a typical door inside handle device and door latch.
Figure 2:
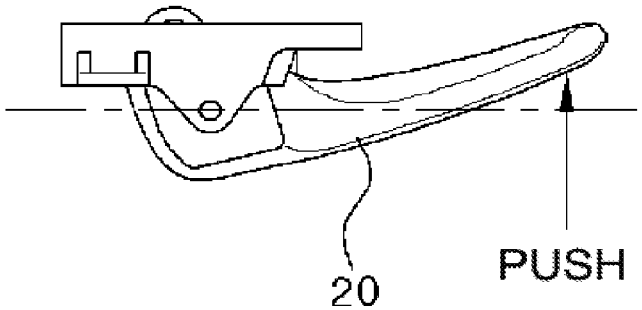
FIG. 2(*a*), FIG. 2(*b*), FIG. 2(*c*) are views illustrating operation states of a typical door inside handle device.
Figure 2:
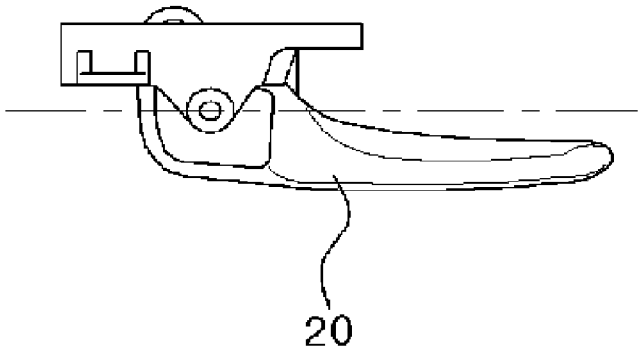
Figure 2:
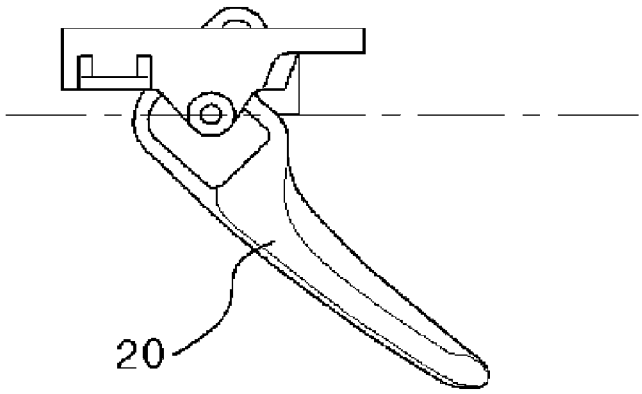

Reference numerals set forth in the Drawings includes reference to the following elements as further discussed below:

It should be understood that the accompanying drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The present invention provides a door inside handle device for a vehicle, which can perform the locking/unlocking of a door latch and the opening of a door by the operation of same knob and handle as a related art by applying a typical safety lock knob which is familiar to users in a method of using a single cable connected to the door latch.

Figure 3:
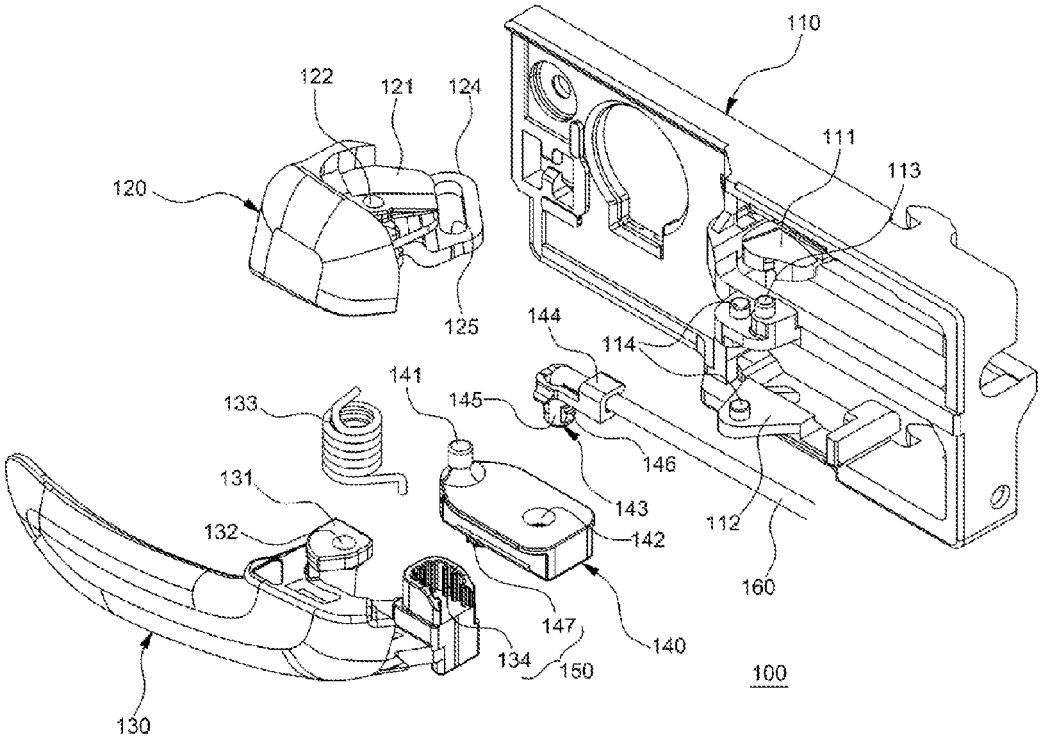
FIG. 3 is an exploded perspective view of an exemplary door inside handle device according to the present invention.
Figure 4:
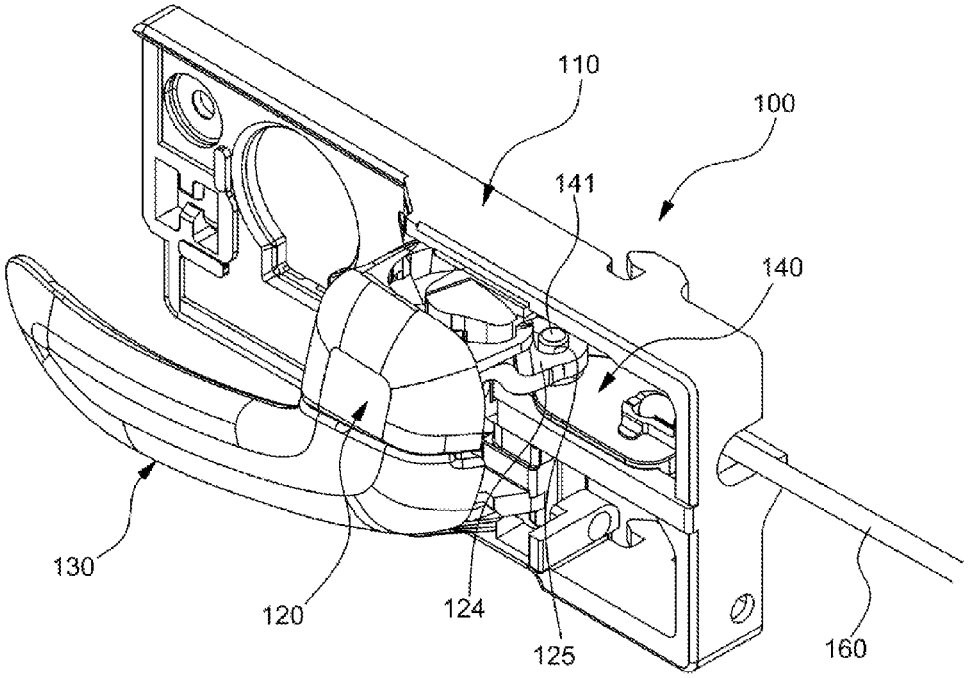
FIG. 4 is an assembly perspective view of a door inside handle device illustrating a state of a safety lock knob operated in a lock direction.
Figure 5:
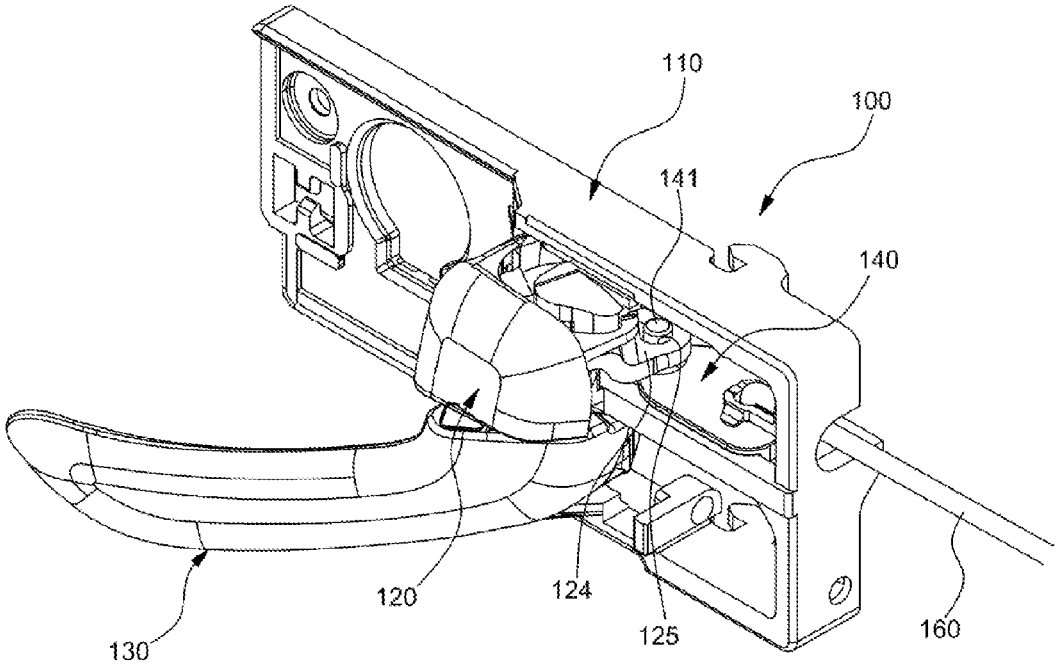
FIG. 5 is an assembly perspective view of a door inside handle device illustrating a state of a handle pulled in a safety lock state.

FIG. 3 is an exploded perspective view of a door inside handle device 100 according to various embodiments of the present invention, and FIGS. 4 to 7 are assembly perspective views of a door inside handle device according to various embodiments of the present invention. FIG. 4 is a view illustrating a state of a safety lock knob 120 operated in a lock direction (door latch and door become unlocked), and FIG. 5 is a view illustrating a state of a handle 130 pulled in a safety lock state.

Figure 6:
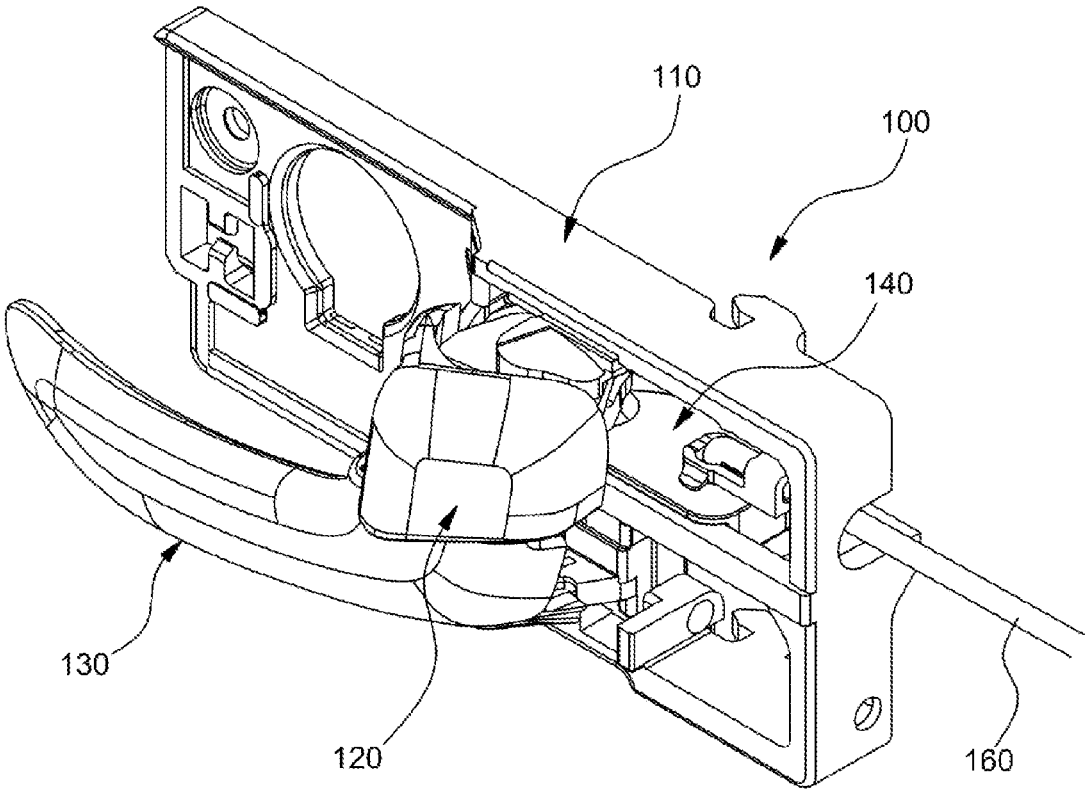
FIG. 6 is an assembly perspective view of a door inside handle device illustrating a safety lock knob operated in an unlock direction.
Figure 7:
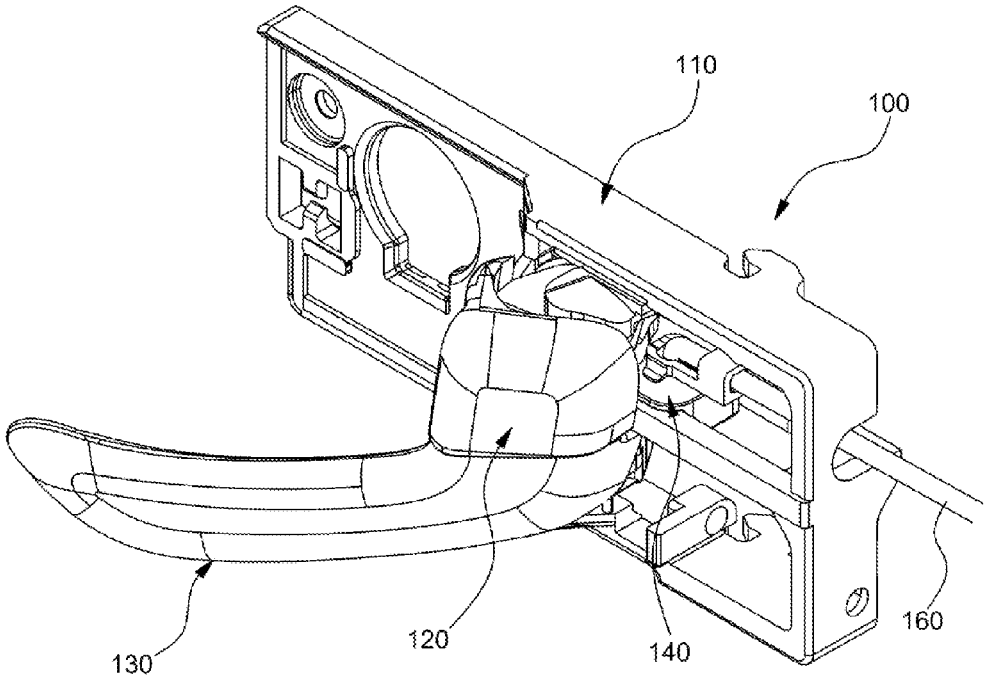
FIG. 7 is an assembly perspective view of a door inside handle device illustrating a handle pulled to open a door in an unlock state of a safety lock knob.

FIG. 6 is a view illustrating the safety lock knob 120 operated in an unlock direction, and FIG. 7 is a view illustrating the handle 130 pulled to open a door in an unlock state of the safety lock knob 120.

Figure 8:
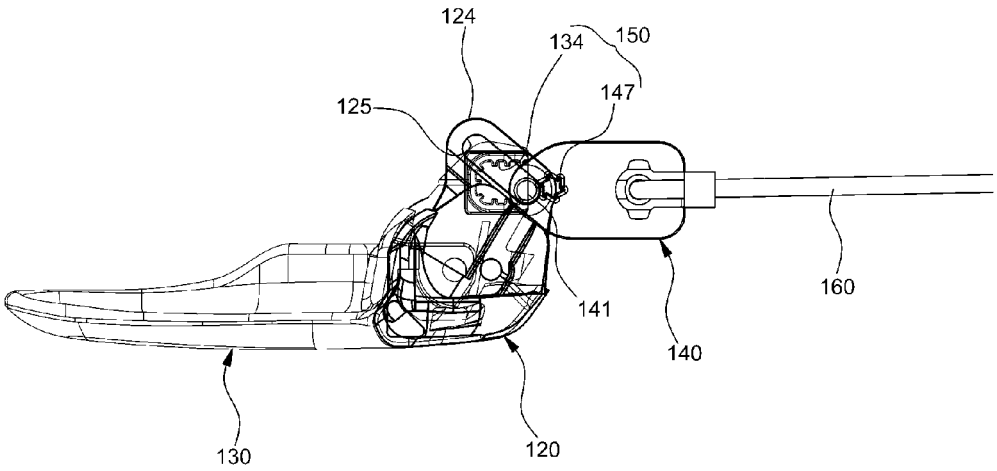
FIG. 8, which corresponds to FIG. 4, is a view illustrating a lock operation state of a safety lock knob.

FIGS. 8 to 11 are views illustrating an operation state of the door inside handle device 100 according to various embodiments of the present invention. FIG. 8, which corresponds to the operation state of FIG. 4, is a view illustrating a lock operation state of the safety lock knob 120, and FIG. 9, which corresponds to the operation state of FIG. 5, is a view illustrating a state of the handle 130 pulled in a safety lock state.

Figure 10:
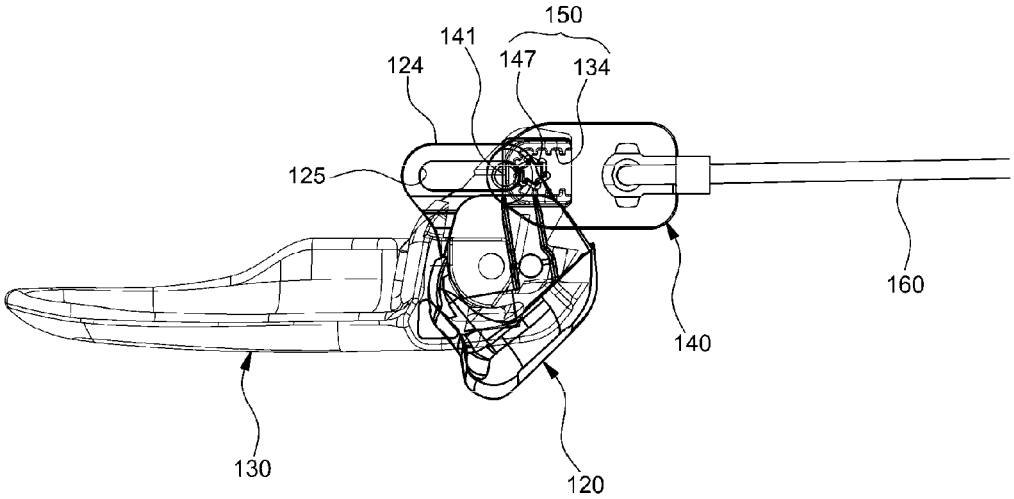
FIG. 10 is a view illustrating an operation state of a door inside handle device according to the present invention.
Figure 11:
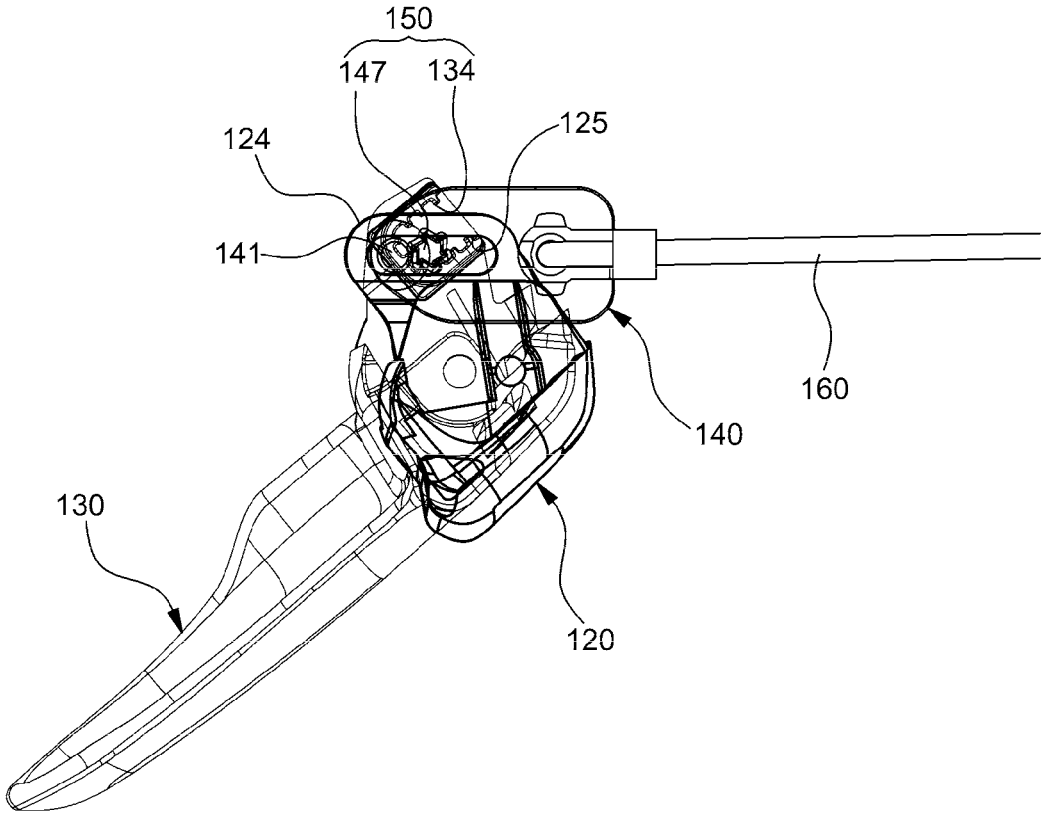
FIG. 11 is a view illustrating an operation state of a door inside handle device according to the present invention.

Also, FIG. 10, which corresponds to the operation state of FIG. 6, is a view illustrating an unlock operation state of the safety lock knob 120, and FIG. 11, which corresponds to the operation state of FIG. 7, is a view illustrating a state of the handle 120 pulled in the unlock operation state of the safety lock knob 120.

As shown in FIG. 3, the door inside handle device 100 may include a base 110 fixedly mounted on the inner side of a door panel, a safety lock knob 120 pivotably disposed on the base 110, a handle 130 pivotably disposed on the base 110, a clutch lever 140 coupled to the safety lock knob 120 and a cable 160 connected to the door latch to deliver an operation force of the safety lock knob 120 to the cable 160 and selectively deliver an operation force of the handle 130 to the cable 160, and a clutch unit 150 disposed between the handle 130 and the clutch lever 140 to deliver or intermit the operation force of the handle 130 according to the operation state of the safety lock knob 120.

In addition to the above configuration, although not shown, a housing that covers other parts except a handle part and a knob part exposed to the interior of a vehicle may be coupled to the base 110.

First, the safety lock knob (hereinafter, referred to as a 'knob') 120 and the handle 130 may be disposed at upper and lower sides of the base 110.

Also, the knob 120 and the handle 130 may be pivotably mounted on the base 110, respectively. In this case, unlike a typical mounting structure (having the same hinge) in which the knob 120 and the handle 130 are disposed at the same axis to have a rotation center on the same axial line, the knob 120 and the handle 130 according to various embodiments of the present invention may be mounted by an independent pin coupling method in which the knob 120 and the handle 130 have different rotation centers.

That is, a support part 121 formed at a rear side of the knob 120 may have pin apertures 122 formed at upper and lower portions thereof, respectively. Upper and lower hinge pins 113 may be protrusively formed in the base to be inserted into the upper and lower pin apertures 122 of the knob 120. The upper and lower hinge pins 113 of the base 110 may be inserted into the upper and lower pin apertures 122, respectively, allowing the knob 120 to be coupled to the base 110.

Also, upper and lower coupling part 131 formed at an end portion of the handle 130 may have pin apertures 132, respectively. Upper and lower hinge pins 114 may be protrusively formed in the base to be inserted into the upper and lower pin apertures 132 of the handle 130. The upper and lower hinge pins 114 of the base 110 may be inserted into the upper and lower pin apertures 132, respectively, allowing the handle 130 to be coupled to the base 110.

Thus, the knob 120 and the handle 130 may be mounted to be pivotable on the respective hinge pins 113 and 114 that are rotation centers.

The upper and lower hinge pins 113 of the base 110 coupled to the knob 120 and the upper and lower hinge pins 114 of the base 110 coupled to the handle 130 may protrude upward and downward from the coupling parts 111 and 112 protruding from the base 110 to the knob 120 and the handle 130, respectively.

Also, since the handle 130 is a part that requires an elastic operation, a return spring 133 may be disposed so as to provide an elastic force that restores the handle 130 in the base 110 when the handle 130 is released from the hand.

The return spring 133 may include a coil spring 133 disposed between the handle 130 and the base 110 on the axial line that connects the upper and lower hinge pins 114 of the base 110 that are the rotation centers of the handle 130.

In this case, one end of the coil spring 133 may be fixedly coupled to the handle 130, and the other end thereof may be fixedly coupled to the base 110.

A link part 124 may protrude from the rear side of the knob 120 for the connection with the lever 140. The link part 124 may have a straight slot 125 which a connection pin 141 of the clutch lever 140 is inserted into.

Also, the connection pin 141 may upwardly protrude from one end portion of the clutch lever 140. The connection pin 141 may be inserted into and coupled to the slot 125 of the link part 124.

Accordingly, in a state where the connection pin 141 is inserted into the slot 125, when the knob 120 is unlocked, the connection pin 141 may be pulled by the link part 124, allowing the clutch 140 to move and thus allowing the cable 160 to be pulled such that the door latch can be unlocked.

Also, in the unlock operation state of the knob 120, as described later, the clutch lever 140 may be connected to the handle 130 so as to receive an operation force through the clutch unit 150.

Accordingly, in this state, when the handle 130 is pulled, the operation force applied to the handle 130 may allow the clutch lever 140 to move, allowing the cable 160 to be pulled such that the door can be opened.

Thus, since the link part 124 and the clutch lever 140 are connected to each other via the slot 125 and the connection pin 141, upon unlock operation of the knob 120, the link part 124 may pull the clutch lever 140 in a state where the connection pin 141 is stopped at the end of the slot 125, allowing the cable 160 to operate. Thus, the operation force applied to the knob 120 may be delivered to the cable 160.

Furthermore, the connection pin 141 of the clutch lever 140 may be coupled so as to be guided along the slot 125 of the link 124. Accordingly, when the handle 130 is pulled in the unlock operation state of the knob 120, the connection pin 141 may be straightly guided along the slot 125, allowing the clutch lever 140 and the cable 160 to be pulled and thus allowing the door to be opened.

Also, as described above, when the knob 120 or the handle 130 is operated, the clutch lever 140 and the cable 160 may move in a substantially straight-line (see FIGS. 8 to 11).

The clutch lever 140 may be rotatably coupled to the end portion of the cable 160 that is introduced in a substantially horizontal direction. A connection member 143 fixedly coupled to the end portion of the cable 160 may be rotatably inserted into and coupled to a coupling aperture 142 of the clutch lever 140.

In this case, a coupling part 144 which the outer circumference of the cable 160 introduced in a vertical direction is inserted into may be disposed at one side of the connection member 143, and a cylindrical insertion part 145 that is inserted into the coupling aperture 142 of the clutch lever 140 may be downwardly disposed at the other end of the connection member 143.

The coupling method between the connection member 143 and the clutch lever 140 may be implemented by a hook coupling method. A hook 146 may be formed on the outer circumferential surface of the insertion part 145 of the connection member 143, and the coupling aperture 142 may penetrate the top surface portion of the clutch lever 140 of a case structure having an internal space. When the insertion part 145 is inserted into the coupling aperture 142, the hook 146 may pass through the coupling aperture 142 and then may be hooked to the inner side surface of the top surface portion.

When the insertion part 145 is inserted into the coupling aperture 142 by this coupling method, the connection member 143 may be maintained at a state of being rotatably coupled to the coupling aperture 142.

Meanwhile, the clutch lever 140 may be a part that delivers the operation forces applied to the knob 120 and the handle 130 to the cable 160, and may serve to connect or disconnect between the handle 130 and the cable 160 together with the clutch unit 150.

The clutch unit 150 may be disposed between the handle 130 and the clutch lever 140. The clutch unit 150 may allow the clutch lever 140 to be power-transmittably connected to the handle 130 or to be disconnected from the handle 130 so as to interrupt the power transmission according to the operation state of the knob 120.

The connection between the handle 130 and the cable 160 by the clutch lever 140 and the clutch unit 150 may mean a condition that the operation force applied to the handle 130 can be delivered to the cable 160. This condition can be implemented by power-transmittably coupling the clutch lever 140 to the handle 130 via the clutch unit 150.

When the clutch lever 140 is power-transmittably coupled to the handle 130, the operation force applied to the handle 130 may be delivered to the cable 160 through the clutch lever 140. In this case, when the handle 130 is pulled, the cable 160 may be pulled to open the door.

Also, the disconnection between the handle 130 and the cable 160 by the clutch lever 140 and the clutch unit 150 may mean a condition that the operation force applied to the handle 130 cannot be delivered to the cable 160. This condition can be implemented by disconnecting the clutch lever 140 from the handle 130 via the clutch unit 150 such that the applied force cannot be delivered.

When the clutch lever 140 is disconnected from the handle 130 such that the applied force cannot be delivered, the operation force applied to the handle 130 may not be delivered to the clutch lever 140 and the cable 160. Accordingly, even though the handle 130 is pulled, the handle 130 may pivot without a reaction force, allowing the cable 160 not to be pulled and thus allowing the door not to be opened.

Hereinafter, the configuration of the clutch unit 150 disposed between the handle 130 and the clutch lever 140 will be described. An engagement part 147 with gear teeth formed on the outer circumferential surface thereof may vertically and downwardly protrude from an end portion of the clutch lever 140. A reception part 134 may be disposed at an end portion of the handle 130 such that the engagement part 147 formed on the clutch lever 140 may be mounted in the end portion of the handle 130.

The reception part 134 may have a shape with one side opened, and the engagement part 147 of the clutch lever 140 may move while being inserted into the reception part 134. As shown in FIG. 3, the reception part 134 may have a U-shape.

The reception part 134 may provide a substantially straight internal passage through which the engagement part 147 formed on the clutch lever 140 can move. While the knob 120 of a lock operation state is being unlocked, the connection pin 141 of the clutch lever 140 may move along the rotation track centering on the rotation center of the knob 120 (movement from state of FIG. 8 to state of FIG. 10). However, since the connection pin 141 moves along the large radius of curvature, the engagement part 147 may move in a nearly straight-line inside the reception part 134, and the clutch lever may also move in a nearly straight-line.

Particularly, while the handle 130 is being pulled so as to open the door from the unlocked state of the knob 120, the connection pin 141 may be guided and moved along the straight slot 125. Accordingly, the clutch lever 140 and the cable 160 may move in a straight-line.

The engagement part 147 may be disposed on the under-surface of the end portion of the clutch lever where the connection pin 141 is disposed. The reception part 134 may have a shape with one side opened, and may have teeth on the inner circumferential surface thereof, which can engage with the teeth of the engagement part 147.

Accordingly, when the clutch lever 140 is moved by the knob 120 and thus the engagement part 147 is adhered closely to the inner side surface of the reception part 134, the handle 130 and the clutch lever 140 may engage with each other, and the operation force applied to the handle 130 may be delivered to the cable 160 through the clutch lever 140.

The reception part 134 and the engagement part 147 may constitute the clutch unit 150 that power-transmittably connect or disconnect between the handle 130 and the clutch lever 140, furthermore, between the handle 130 and the cable 160 according to the operation state of the knob 120.

When the clutch lever 140 moves in a counter direction upon unlocking of the knob 120 (cable pulls clutch lever), the engagement part 147 may become spaced from the inner side surface of the reception part 134, and the engagement state therebetween may be released. In this state, the operation force applied to the handle 130 may not be delivered to the clutch lever 140.

Hereinafter, the operation state of various embodiments will be described in detail.

The door inside handle device 100 may be connected to the door latch via one cable 160 to deliver operation forces applied to the knob 120 and the handle 130, and one end portion of the cable 160 may be coupled to the clutch lever 140, and the other end portion of the cable 160 may be connected to the door latch.

Here, the door latch may include a door latch which is disclosed in Korean Patent No. 10-1091658. The door latch may move in linkage with the operation of the door inside handle device 100 connected through the cable 160 to perform locking/unlocking and opening of the door.

Regarding the basic operation relation, upon pivoting of the knob 120, the clutch lever 140 coupled to the knob 120 via the slot 125 and the connection pin 141 may move. Particularly, upon unlocking of the knob 120, the clutch lever 140 connected through the link part 124 may be pulled and moved, and simultaneously, the cable 160 may be pulled by the clutch lever 140 that moves.

Here, when the cable 160 is pulled by the clutch lever 140, the door latch may become unlocked, and the pulling of the cable 160 by the clutch lever 140 may be released, allowing the cable 160 to move in a counter direction. In this case, the door latch may become locked. Since the locking/unlocking of the door latch by the operation of the cable 160 is well known, a detailed description thereof will be omitted herein.

Also, the clutch lever 140 may be power-transmittably connected to or disconnected from the handle 130 according to the movement direction of the clutch lever 140. In the connection state, the cable may be pulled when the handle 130 is operated, and in the disconnection state, the cable 160 may not be pulled and the handle 130 may pivot without a reaction force even though the handle 130 is operated.

Also, in the unlocking state (unlock operation state of the knob and state where the clutch lever is power-transmittably connected to the handle) of the door latch, when the handle 130 is operated, the cable 160 may be pulled, allowing the door to be opened. In the locking state (lock operation state of knob and state where the clutch lever is disconnected from the handle) of the door latch, the handle 130 may pivot without a reaction force, allowing the cable 160 not to be pulled and thus allowing the door not to be opened.

FIGS. 4 and 8 show that the knob 120 is operated in the lock direction (pushed state), and FIGS. 6 and 10 show that the knob 120 is operated in the unlock direction (protruding state toward inside of vehicle).

Figure 9:
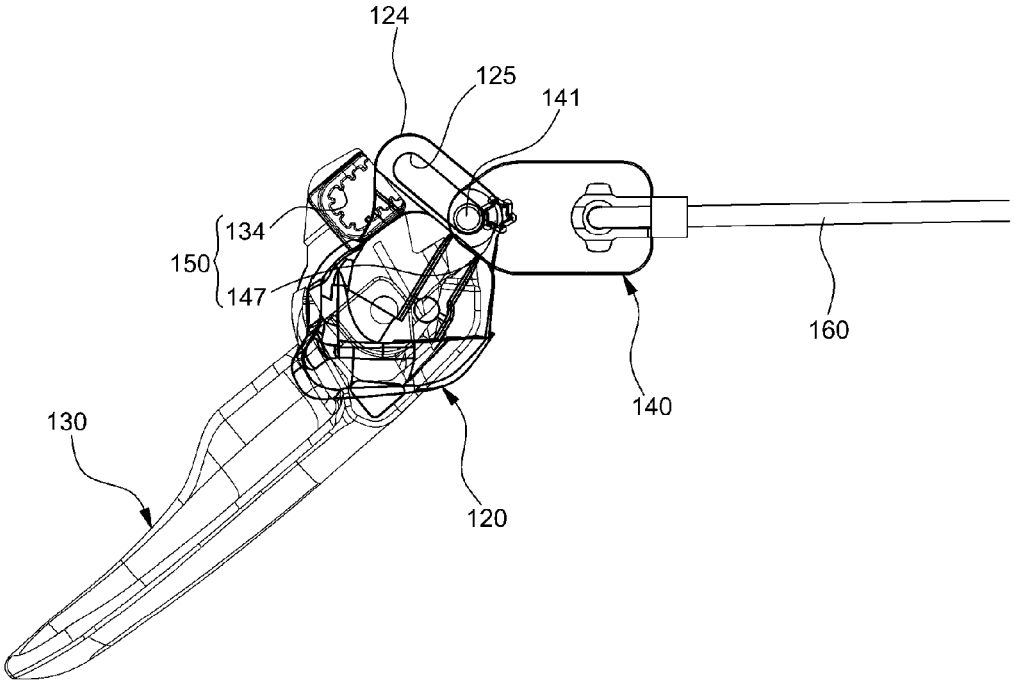
FIG. 9, which corresponds to FIG. 5, is a view illustrating a state of a handle pulled in a safety lock state.

Also, FIGS. 5 and 9 show that the handle 130 is operated in a state where the knob 120 is operated in the lock direction, and FIGS. 7 and 11 show that the handle 130 is operated in a state where the knob 120 is operated in the unlock direction.

First, in a state where the knob 120 is operated in the lock direction (lock state of door latch), the engagement state between the reception part 134 formed in the handle 130 and the engagement part 147 formed in the clutch lever 140 may be released (teeth of both sides are separated from each other). Accordingly, the operation force applied to the handle 130 may not be delivered to the clutch lever 140 and the cable 160 (see FIG. 8).

Accordingly, even though the handle 130 is operated as shown in FIG. 9, the operation force may not be delivered to the clutch lever 140, and thus the cable 160 may not be pulled, allowing the handle 130 to pivot without a reaction force.

Next, when the knob 120 is operated in the unlock direction, the clutch lever 140 connected to the knob 120 via the slot 125 and the connection pin 141 may be pulled and moved at the same time when the knob 120 rotates, and this movement of the clutch lever 140 may allow the engagement part 147 to be adhered closely to the inner side surface of the reception part 134 of the handle 130 (see FIG. 10).

Also, at the same time as the movement of the clutch lever 140, the cable 160 may be pulled, allowing the door latch to become unlocked.

Furthermore, when the engagement part 147 adheres closely to the inner side surface of the reception part 134, the teeth of the reception part 134 and the engagement part 147 may engage with each other (teeth of both sides are engaged with each other), allowing the operation force applied to the handle 130 to be deliverable to the clutch lever 140.

In this state, when the handle 130 is operated, as shown in FIG. 11, the clutch lever 140 and the cable 160 may be pulled at the same time as the rotation of the handle 130, allowing the door to be opened.

On the contrary, in the unlock state of FIG. 10, when the knob 120 is operated in the lock direction, the clutch lever 140 may move in a counter direction at the same time as the rotation of the knob 120, returning to the state of FIG. 8. Also, these movements of the clutch lever 140 and the cable 160 may allow the door latch to become locked again.

In this lock state of the door, as described above, the reception part 134 of the handle 130 and the engaging part 147 of the clutch lever 140 may be disengaged from each other, and thus the operation force applied to the handle 130 may not be delivered to the clutch lever 140 and the cable 160.

Finally, even though the handle 130 is operated, the operation force may not be delivered to the clutch lever 140, and thus the cable 160 may not be pulled, allowing the handle 130 to pivot without a reaction force.

In a door inside handle device according to various embodiments of the present invention, a clutch unit is provided to transmit and intermit power between a handle and a cable according to the operation state of a safety lock knob, allowing a user to perform locking/unlocking and opening of a door by operating the same knob and handle as a related art in a vehicle to which one-cable operation method is applied. Accordingly, since it is possible for a user to operate the door inside handle device by an easy and familiar method, the convenience of the operation can be improved while taking advantage of the one-cable operation method.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door inside handle device for a vehicle, the door inside handle device comprising:

a base configured to be mounted on a door panel;

a safety lock knob pivotably disposed on the base;

a handle pivotably disposed on the base;

a clutch lever coupled to the safety lock knob and a cable connected to a door latch to deliver operation force applied to the safety lock knob to the cable and selectively deliver operation force applied to the handle to the cable; and a clutch unit disposed between the handle and the clutch lever to selectively transmit operation force applied to the handle to the clutch lever according to an operation state of the safety lock knob, wherein the safety lock knob and the clutch lever are coupled by a slot longitudinally formed and a connection pin inserted into the slot such that the cable operates while the clutch lever is moved by the operation force applied to the safety lock knob, wherein in a state where the connection pin is inserted into the slot, when the safety lock knob is unlocked, the connection pin is pulled by the slot while being stopped at an end of the slot, and thus the clutch lever and the cable are pulled, and wherein when the handle is pulled after the safety lock knob is unlocked, the connection pin is guided along the slot, allowing the clutch lever and the cable to be pulled.

2. The door inside handle device of claim 1, wherein the safety lock knob and the handle are mounted on the base by an independent pin coupling method in which the safety lock knob and the handle are coupled to hinge pins protruding from the base, respectively, pivoting on the hinge pins.

3. The door inside handle device of claim 1, wherein the slot is formed in a link part disposed on the safety lock knob, and the connection pin protrudes from the clutch lever.

4. The door inside handle device of claim 1, wherein the slot extends longitudinally in a straight-line.

5. The door inside handle device of claim 1, comprising a connection member fixedly coupled to an end portion of the cable and inserted into a coupling aperture of the clutch lever.

6. The door inside handle device of claim 1, wherein the clutch unit comprises;

an engagement part longitudinally protruding from the clutch lever and comprising gear teeth formed on an outer circumferential surface thereof; and a reception part disposed at an end portion of the handle to receive the engagement part and comprising teeth on an inner side surface thereof to engage with the engagement part when the clutch lever is moved by an unlock operation of the safety lock knob.

7. The door inside handle device of claim 6, wherein the reception part has a U-shape with one open side.

8. A door inside handle device for a vehicle, the door inside handle device comprising:

a base configured to be mounted on a door panel;

a safety lock knob pivotably disposed on the base;

a handle pivotably disposed on the base;

a clutch lever coupled to the safety lock knob and a cable connected to a door latch to deliver operation force applied to the safety lock knob to the cable and selectively deliver operation force applied to the handle to the cable; and a clutch unit disposed between the handle and the clutch lever to selectively transmit operation force applied to the handle to the clutch lever according to an operation state of the safety lock knob, wherein the clutch unit comprises;

an engagement part longitudinally protruding from the clutch lever and comprising gear teeth formed on an outer circumferential surface thereof; and a reception part disposed at an end portion of the handle to receive the engagement part and comprising teeth on an inner side surface thereof to engage with the engagement part when the clutch lever is moved by an unlock operation of the safety lock knob.

9. The door inside handle device of claim 8, wherein the reception part has a U-shape with one open side.

* * * * *